US008774679B2

(12) United States Patent
Rimai et al.

(10) Patent No.: US 8,774,679 B2
(45) Date of Patent: Jul. 8, 2014

(54) ELECTROGRAPHIC TACTILE IMAGE PRINTING SYSTEM

(75) Inventors: Donald Saul Rimai, Webster, NY (US); Hwai-Tzuu Tai, Rochester, NY (US); Thomas Nathaniel Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 84 days.

(21) Appl. No.: 13/591,259

(22) Filed: Aug. 22, 2012

(65) Prior Publication Data

US 2014/0056617 A1 Feb. 27, 2014

(51) Int. Cl.
*G03G 15/22* (2006.01)

(52) U.S. Cl.
USPC ..... 399/130

(58) Field of Classification Search
USPC ..... 399/130
See application file for complete search history.

(56) References Cited

U.S. PATENT DOCUMENTS

| | | | |
|---|---|---|---|
| 4,073,070 | A | 2/1978 | Boston |
| 4,972,501 | A | 11/1990 | Horyu |
| 5,125,996 | A | 6/1992 | Campbell et al. |
| 6,608,641 | B1 | 8/2003 | Alexandrovich |
| 6,728,503 | B2 | 4/2004 | Stelter et al. |
| 6,755,350 | B2 | 6/2004 | Rochford et al. |
| 7,014,910 | B2 | 3/2006 | Rochford et al. |
| 7,120,379 | B2 | 10/2006 | Eck et al. |
| 7,290,951 | B2 | 11/2007 | Tanaka et al. |
| 8,064,788 | B2 | 11/2011 | Zaretsky et al. |
| 8,147,948 | B1 | 4/2012 | Tyagi et al. |
| 2002/0003469 | A1 | 1/2002 | Gupta |
| 2006/0133870 | A1 | 6/2006 | Ng et al. |
| 2008/0159786 | A1 | 7/2008 | Tombs et al. |
| 2011/0200360 | A1 | 8/2011 | Tyagi et al. |
| 2011/0200932 | A1 | 8/2011 | Tyagi et al. |
| 2011/0200933 | A1 | 8/2011 | Tyagi et al. |

*Primary Examiner* — Ryan Walsh
(74) *Attorney, Agent, or Firm* — Kevin E. Spaulding

(57) ABSTRACT

An electrographic printing system for forming a tactile printed image on a receiver medium, comprising an image processing path, one or more printing modules and a fixing subsystem. The image processing path provides a sequence of image patterns including a plurality of annular shapes having associated inner and outer sizes, the inner and outer sizes of the annular shapes varying in a monotonic sequence. The printing modules are controlled to form a sequence of toner particle images corresponding to the sequence of image patterns, and to sequentially transfer the sequence of toner particle images in register onto the receiver medium such that the annular shapes in the toner particle images overlap to form a tactile image feature having a hollow core. The fixing subsystem is used to permanently attach the transferred toner particle images to the receiver medium.

13 Claims, 10 Drawing Sheets

ELECTROGRAPHIC TACTILE IMAGE PRINTING SYSTEM

CROSS-REFERENCE TO RELATED APPLICATIONS

Reference is made to commonly assigned, co-pending U.S. patent application Ser. No. 13/461,875, entitled "Printed image for visually-impaired person," by Delmerico; and to commonly assigned, co-pending U.S. patent application Ser. No. 13/591,256, entitled "Electrographic printing of tactile images," by Rimai et al., each of which is incorporated herein by reference.

FIELD OF THE INVENTION

This invention pertains to the field of electrographic printing and more particularly to an electrographic printer that forms tactile images.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

The magnitude of the charge on the toner particles is of vital importance in electrophotography and generally limits both the amount of toner deposited in an area and the size of the toner particles. This is discussed in commonly-assigned U.S. Pat. No. 8,147,948 to Tyagi et al., entitled "Printed article," which is incorporated herein by reference. Specifically, the amount of toner deposited to convert the electrostatic latent image on the photoreceptor is proportional to the difference of potential between a development station that is used to transport the electrically charged toner particles into operative proximity to the latent image bearing photoreceptor and the photoreceptor. The photoreceptor is initially charged to a potential using known means such as a corona or roller charger and an electrostatic latent image is formed on the photoreceptor by image-wise exposing, thus discharging the photoreceptor in an image-wise fashion. The initial potential is limited by the dielectric strength of the photoreceptor. For a typical organic photoreceptor commonly used today, the initial potential is limited to less than approximately 500 V. The potential on the development station is limited by the necessity of not depositing toner particles in un-toned areas. Thus, the magnitude of the minimum difference of potential must be sufficient to preferentially attract the charge toner particles towards the development station in regions where toner particles should not be deposited on the photoreceptor.

After development of the electrostatic latent image to convert the electrostatic latent image into the toner image, the toner image is transferred from the photoreceptor to a receiver such as paper. Transfer is generally accomplished by transporting the toner image-bearing photoreceptor into contact with a receiver and subjecting the photoreceptor-receiver to an electrostatic field and pressure that urges the toner particles to transfer from the photoreceptor to the receiver. Countering the applied electrostatic forces resulting from the applied electrostatic field are electrostatic forces between the charged toner particles and the photoreceptor and surface forces such as those arising from van der Waals interactions that adhere the toner particles to the photoreceptor. The applied electrostatic force must be sufficient to overcome the forces that hold the toner to the photoreceptor in order for the toner particles to be transferred to the receiver.

The applied electrostatic force exerted on a toner particle is the product of the charge on the toner particle times the applied electrostatic transfer field. Increasing the charge on a toner particle increases the adhesion of that particle to the photoreceptor. Moreover, the field generated by the charged toner particles counters and reduces the applied electrostatic transfer field. Thus, increasing toner charge decreases the force available to transfer the toner particles from the photoreceptor to the receiver. This makes transfer more difficult. In addition, increasing toner charge also limits the amount of toner that is deposited during the development process when the electrostatic latent image is converted into a visible image. It is obvious that the amount of charge that can be imparted onto a toner particle is necessarily limited.

The magnitude of the electrostatic transfer field is limited by the Paschen discharge limit of air. Air can support a maximum applied field, known as the Paschen limit. The Paschen limit decreases with increasing air gap. For a 10 μm air gap, the limit is approximately 35 V/μm. As the size of the gap increases, as would occur when making raised letter printing or other applications that require the formation of macroscopic toner structures such as Braille, textured effects, etc. the size of the electrostatic transfer field that can be applied decreases as the size of the relief pattern generated to provide the raised lettering or macroscopic toner structures increases. Moreover, the presence of macroscopic relief structures generally requires the presence of large quantities of electrically charged toner particles. The charge on the toner particles generates an electrostatic field that subtracts from the applied field in the presence of the toner structure while the air gap in the vicinity around the relief structure limits the size of the applied field due to the Paschen discharge limit. Accordingly, it is often not possible to electrostatically transfer macroscopic toner structures generated when forming macroscopic toner structures from the photoreceptor to a receiver. It is clear that a new method of forming macroscopic toner relief patterns is necessary.

There is a need, therefore, for a method capable of developing, transferring, and fusing stacks of toner particles whereby the toner stacks are of sufficient height that allows them to be sensed using tactile means.

SUMMARY OF THE INVENTION

The present invention represents an electrographic printing system for forming a tactile printed image on a receiver medium, comprising:

an image processing path that provides a sequence of image patterns including a plurality of annular shapes having associated inner and outer sizes, the inner and outer sizes of the annular shapes varying in a monotonic sequence;

one or more printing modules including:

an image forming system adapted to form an electrostatic latent image on a primary imaging member according to a supplied image pattern;

a development subsystem adapted to form a toner particle image on the primary imaging member by depositing charged toner particles in accordance with the electrostatic latent image; and a transfer subsystem adapted to transfer the toner particle image to the receiver medium;

a fixing subsystem adapted to permanently attach the transferred toner particle images to the receiver medium; and a controller system adapted to:

control the one or more printing modules to form a sequence of toner particle images corresponding to the sequence of image patterns, and to sequentially transfer the sequence of toner particle images in register onto the receiver medium such that the annular shapes in the toner particle images overlap to form a tactile image feature having a hollow core; and control the fixing subsystem to permanently attach the transferred toner particle images to the receiver medium.

An advantage of this invention is that macroscopic toner relief patterns necessary for the formation of Braille patterns (typically requiring relief patterns of 100 μm in height or greater) and other types of tactile patterns can be formed using electrophotographic printing technology.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
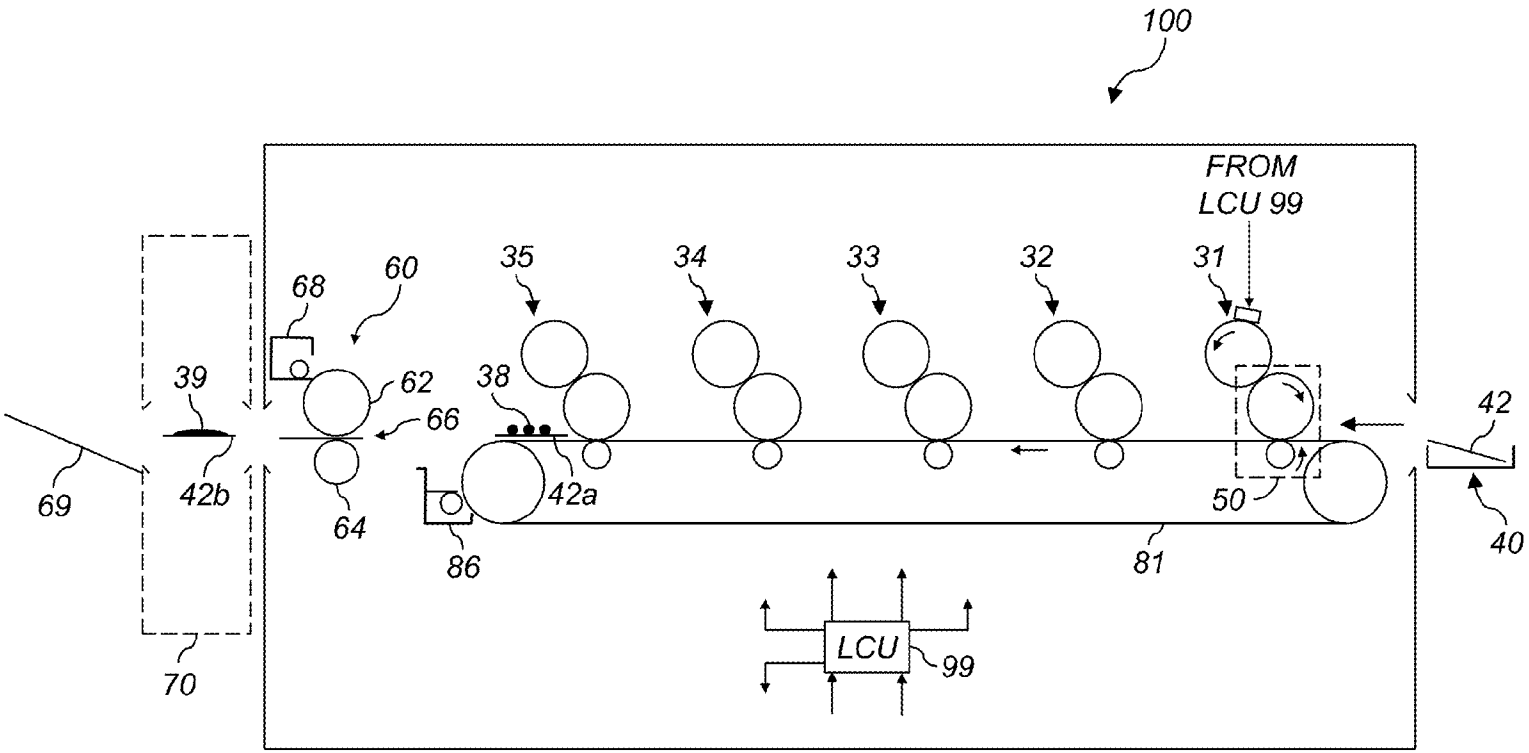
FIG. 1 is an elevational cross-section of an electrophotographic printer suitable for use with various embodiments.

The attached drawings are for purposes of illustration and are not necessarily to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes (e.g., positioned in the center of the sheet in the length dimension, and extending the full width of the sheet). The folded sheet contains two "leaves," each leaf being that portion of the sheet on one side of the fold axis. The two sides of each leaf are referred to as "pages." "Face" refers to one side of the sheet, whether before or after folding.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., toner particles having diameters between 12-30 μm, and preferably having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS 2100 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
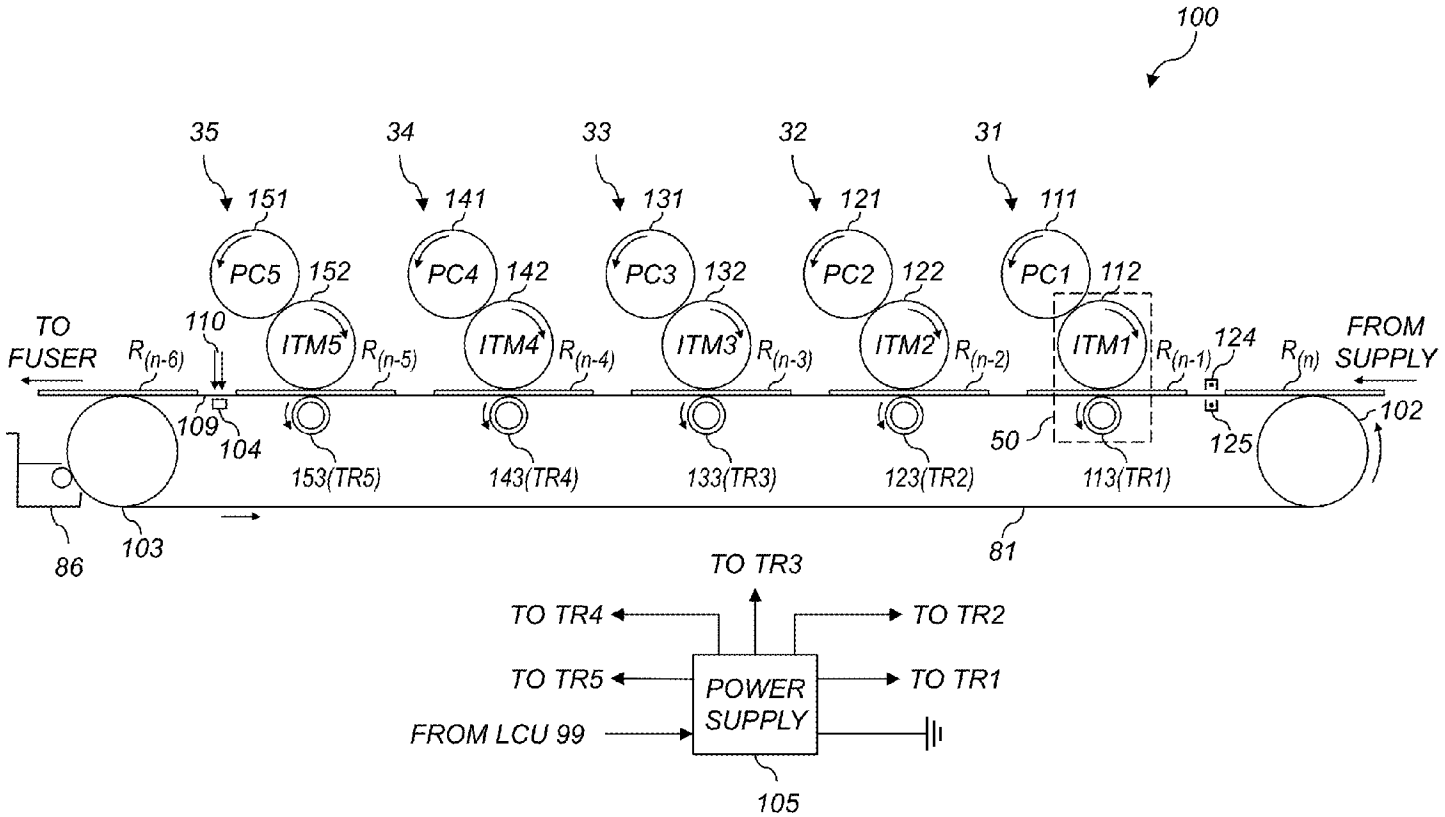
FIG. 2 is an elevational cross-section of the reprographic image-producing portion of the electrophotographic printer of FIG. 1.
Figure 3:
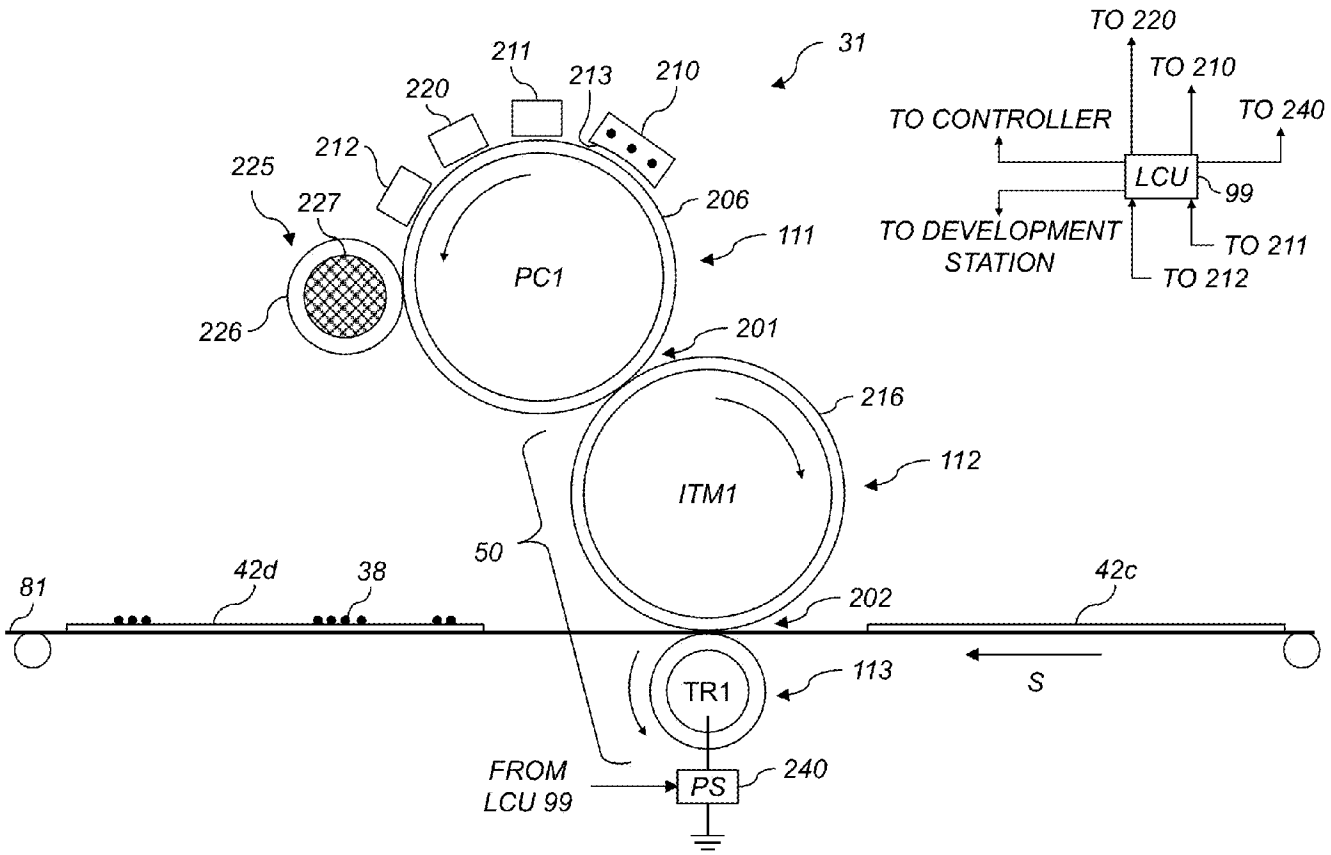
FIG. 3 is an elevational cross-section of one printing module of the electrophotographic printer of FIG. 1.

FIGS. 1-3 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web of, or a cut sheet of, planar media such as paper or transparency film.

Each receiver 42, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 35. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e. a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

Fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to a remote output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory (SPM).

Referring to FIG. 2, which shows additional details of printer 100, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member 111, 121, 131, 141, 151 (PC1, PC2, PC3, PC4, PC5), such as a photoconductive roller or belt, an intermediate transfer member 112, 122, 132, 142, 152 (ITM1, ITM2, ITM3, ITM4, ITM5), e.g., a blanket roller, and transfer backup member 113, 123, 133, 143, 153 (TR1, TR2, TR3, TR4, TR5), e.g., a roller, belt or rod. Thus in printing module 31, a print image (e.g., a black separation image) is created on imaging member 111 (PC1), transferred to intermediate transfer member 112 (ITM1), and transferred again to receiver $R_{(n-1)}$ moving through transfer subsystem 50 that includes transfer member 112 (ITM1) forming a pressure nip with a transfer backup member 113 (TR1). Similar functions are provided by the components of the other printing modules 32, 33, 34, 35. The direction of transport of the receivers is the slow-scan direction; the perpendicular direction, parallel to the axes of the intermediate transfer members 112, 122, 132, 142, 152, is the fast-scan direction.

A receiver, $R_n$, arriving from supply unit 40 (FIG. 1), is shown passing over roller 102 for subsequent entry into the transfer subsystem 50 of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35, respectively. An unfused print image formed on receiver $R_{(n-6)}$ is moving as shown towards fuser module 60 (FIG. 1).

A power supply 105 provides individual transfer currents to the transfer backup members 113, 123, 133, 143, 153. LCU 99 (FIG. 1) provides timing and control signals to the components of printer 100 in response to signals from sensors in printer 100 to control the components and process control parameters of the printer 100. Cleaning station 86 for transport web 81 permits continued reuse of transport web 81. A densitometer array includes a transmission densitometer 104 using a light beam 110. The densitometer array measures optical densities of toner control patches transferred to an inter-frame area 109 located on transport web 81, such that one or more signals are transmitted from the densitometer array to a computer or other controller (not shown) with corresponding signals sent from the computer to power supply 105. Transmission densitometer 104 is preferably located between printing module 35 and roller 103. Reflection densitometers, and more or fewer test patches, can also be used.

FIG. 3 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 or receiver 42 (FIG. 1) which the exposure subsystem 220 (e.g., the laser or the LED) can expose with a selected exposure different from the exposure of another engine pixel. Engine pixels can overlap (e.g., to increase addressability in the slow-scan direction S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In a preferred embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a visible image on photoreceptor 206 (e.g., of a separation corresponding to the color of toner deposited at this printing module). Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., and in U.S. Pat. No. 6,728,503 to Stelter et al., the disclosures of which are incorporated herein by reference. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., receiver 42*c*) which receives a respective toned print images 38 from each printing module in superposition to form a composite image thereon. The print image 38 is, for example, a separation of one color, such as cyan. Receivers 42*c*, 42*d* are transported by transport web 81. Transfer to a receiver is effected by an electrical field provided to transfer backup member 113 by power source 240, which is controlled by LCU 99. Receivers 42*c*, 42*d* can be any objects or surfaces onto which toner can be transferred from imaging member 111 by application of the electric field. In this example, receiver 42*c* is shown prior to entry into a second transfer nip 202, and receiver 42*d* is shown subsequent to transfer of the print image 38 onto receiver 42*d*.

In the illustrated embodiment, the toner image is transferred from the photoreceptor 206 to the intermediate transfer member 112, and from there to the receiver 42*c*. Registration of the separate toner images is achieved by registering the separate toner images on the receiver 42*c*, as is done with the NexPress 2100. In some embodiments, a single transfer member is used to sequentially transfer toner images from each color channel to the receiver 42*c*. In other embodiments, the separate toner images can be transferred in register directly from the photoreceptor 206 in the respective printing module 31, 32, 33, 34, 25 to the receiver 42*c* without using a transfer member. Either transfer process is suitable when practicing this invention. An alternative method of transferring toner images involves transferring the separate toner images, in register, to a transfer member and then transferring the registered image to a receiver. This method of printing an electrophotographic image is generally not suitable for use with the present invention.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

Further details regarding exemplary printer 100 are provided in U.S. Pat. No. 6,608,641 to Alexandrovich et al., and in U.S. Patent Application Publication 2006/0133870, to Ng et al., the disclosures of which are incorporated herein by reference.

Figure 4:
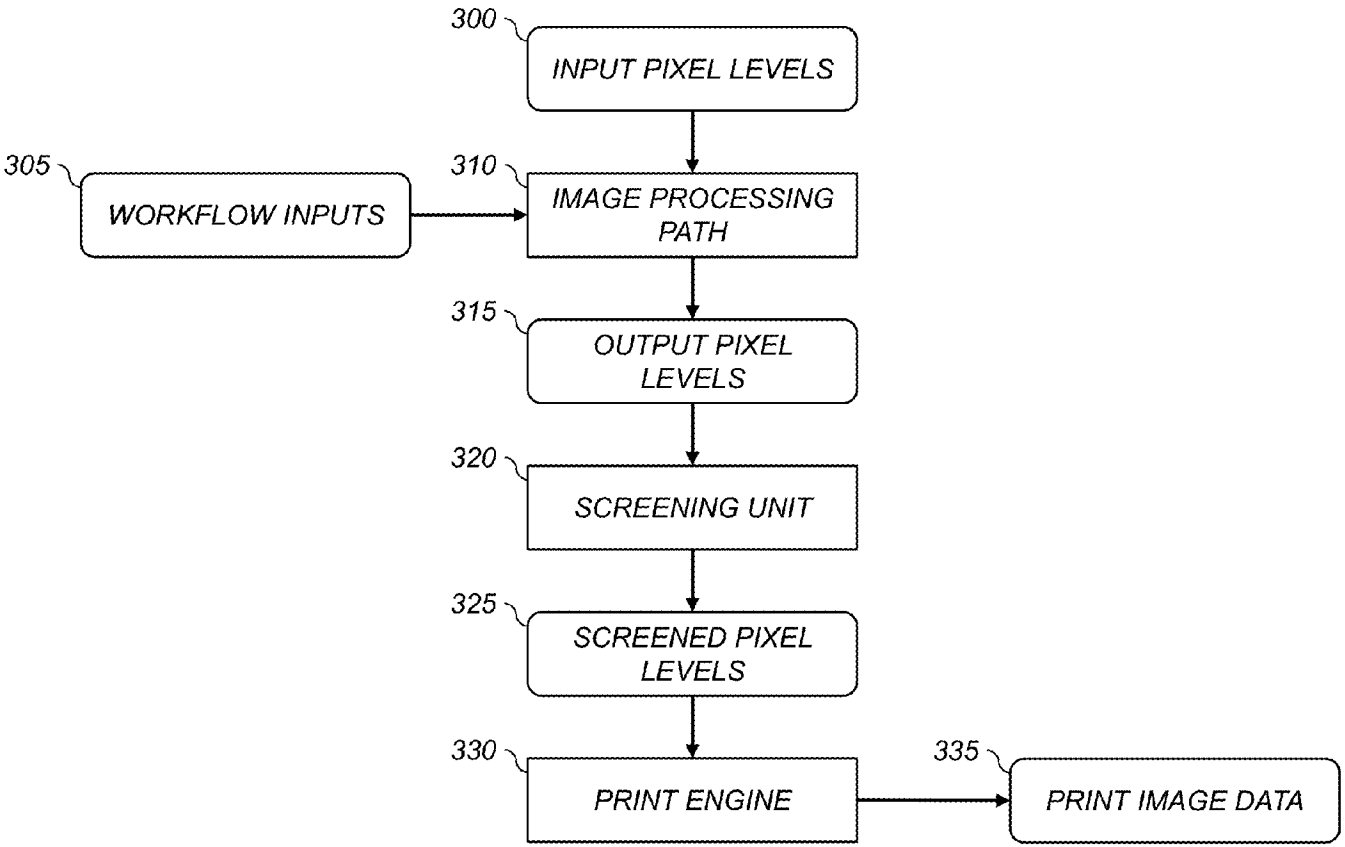
FIG. 4 is a schematic of a data-processing path useful with the present invention.

FIG. 4 shows a data-processing path useful with various embodiments, and defines several terms used herein. Printer 100 (FIG. 1) or corresponding electronics (e.g., the DFE or RIP), operate this data-processing path to produce print image data 335 corresponding to an exposure pattern to be applied to photoreceptor 206 of imaging member 111 (FIG. 3), as described above. The data-processing path can be partitioned in various ways between the DFE, the RIP and the print engine, as is known in the image-processing art.

The following discussion relates to a single input pixel having input pixel levels 300 for a set of input channels. In accordance with the present invention, the input channels can include a set of color channels, as well as one or more channels specifying a tactile pattern to be formed using the printer 100. The input pixel levels 300 have an associated bit-depth, where the term "bit depth" refers to the range and precision of pixel values. In operation, data processing takes place for a plurality of input pixels that together compose an input image. The input image has an input resolution, where the term "resolution" herein refers to spatial resolution, (e.g., in cycles/inch or cycles/degree). Each input pixel has a corresponding pixel location within the input image, where the pixel location refers to a set of coordinates on the surface of receiver 42 (FIG. 1) at which a corresponding amount of toner should be applied.

The printer 100 (FIG. 1) receives the input pixel levels 300. The color of the input pixels can be represented using color channels corresponding to any additive or subtractive color space known in the art. For example, the color values can be represented using sRGB code values, having 8-bit input pixel values for red (R), green (G), and blue (B) color channels. There is one input pixel level 300 for each color channel. Image processing path 310 applies various image processing and color processing operations to convert the input pixel levels 300 to corresponding output pixel levels 315. Generally, the output pixel levels 315 will be in an output color space corresponding to the colorants available in the printing modules 31-35 of the printer 100. The output pixel levels 315 specify desired amounts of the corresponding colorants, which can be, for example, cyan, magenta and yellow (CMY) or cyan, magenta, yellow and black (CMYK) or cyan, magenta, yellow, black and clear (CMYK-clear). Output pixel levels 315 can be linear or non-linear with respect to exposure, density, L*, toner mass, or any other factor known in the art.

The image processing path 310 transforms the input pixel levels 300 to the corresponding output pixel levels 315 responsive to appropriate workflow inputs 305 using any method known in the art. In some embodiments, the image processing path 310 first uses an input device model to transform the input color values to device-independent color values in a device-independent color space such as the well-known ROMM RGB, CIE XYZ and CIELAB color spaces. In some cases, the CIELAB can be encoded according to the well-known ICC Profile Connection Space (PCS) LAB color encoding. An inverse device model for the printer 100 is then used to transform the device-independent color values to determine corresponding output pixel levels 315 that will produce the desired image colorimetry. In some cases, the output pixel levels 315 can be encoded according to a standard CMYK color space such as SWOP CMYK (ANSI CGATS TR001 and CGATS.6), Euroscale (ISO 2846-1:2006 and ISO 12647), or other CMYK standards. In some embodiments, these transformations are performed using a color management system, such as the well-known ICC color management system.

Input pixels are associated with an input resolution in pixels per inch (ippi, input pixels per inch), and output pixels with an output resolution (oppi, output pixels per inch). Image processing path 310 resizes the image (e.g., using bilinear or bicubic interpolation) to modify the resolution when ippi≠oppi. In some cases, different operations in the data path are preferably at different resolutions. In this case, suitable resizing operations can be performed between the different operations.

Screening unit 320 calculates screened pixel levels 325 from output pixel levels 315. The screened pixel levels 325 are at the bit depth required by print engine 330, which generally corresponds to the number of printable levels that can be produced by the printer 100. The screening unit 320 can perform continuous-tone processing operations, as well as halftone processing or multitone processing (i.e., multilevel halftone processing). The halftone or multitone processing operations can use any type of algorithm known in the art including periodic dither or error diffusion. In some embodiments, the screening unit 320, includes a screening memory for storing data such as dither matrices that is used by the halftone/multitone algorithm.

Print engine 330 represents the subsystems in printer 100 that apply an amount of toner corresponding to the screened pixel levels to receiver 42 (FIG. 1) at the respective pixel locations. Examples of these subsystems are described above with reference to FIGS. 1-3. The screened pixel levels and locations can be the engine pixel levels and locations, or additional processing can be performed to transform the screened pixel levels and locations into the engine pixel levels and locations.

In the practice of this invention, toner particles having a conventional diameters, i.e. those having diameters between 6 μm and 12 μm, are suitable. However, to obtain better higher relief, it is preferable to use toner particles that have diameters of at least 20 μm. As previously discussed, toner particles having diameters greater than about 30 μm often are thrown out of the development station 225 because of the mass of the toner particles. This can be especially problematic when the development station 225 contains a magnetic core 227 that rotates. Thus, the preferred diameter of the toner when practicing this invention is between 20 μm and 30 μm.

According to the present invention, tactile images (i.e., images having macroscopic relief) are produced on an electrophotographic printer. An example of a type of tactile image would be Braille images, which are designed to convey information to a visually impaired person. In other cases, the tactile image can be some other type of texture pattern that is to be applied to the surface of the printed image, such as the tactile patterns that are described in commonly-assigned, U.S. patent application Ser. No. 13/461,875 to Delmerico, which is incorporated herein by reference. Such tactile patterns are generally made up of patterns of individual texture elements such as small dots and lines, each of which can be provided in accordance with the present invention.

Figure 5:
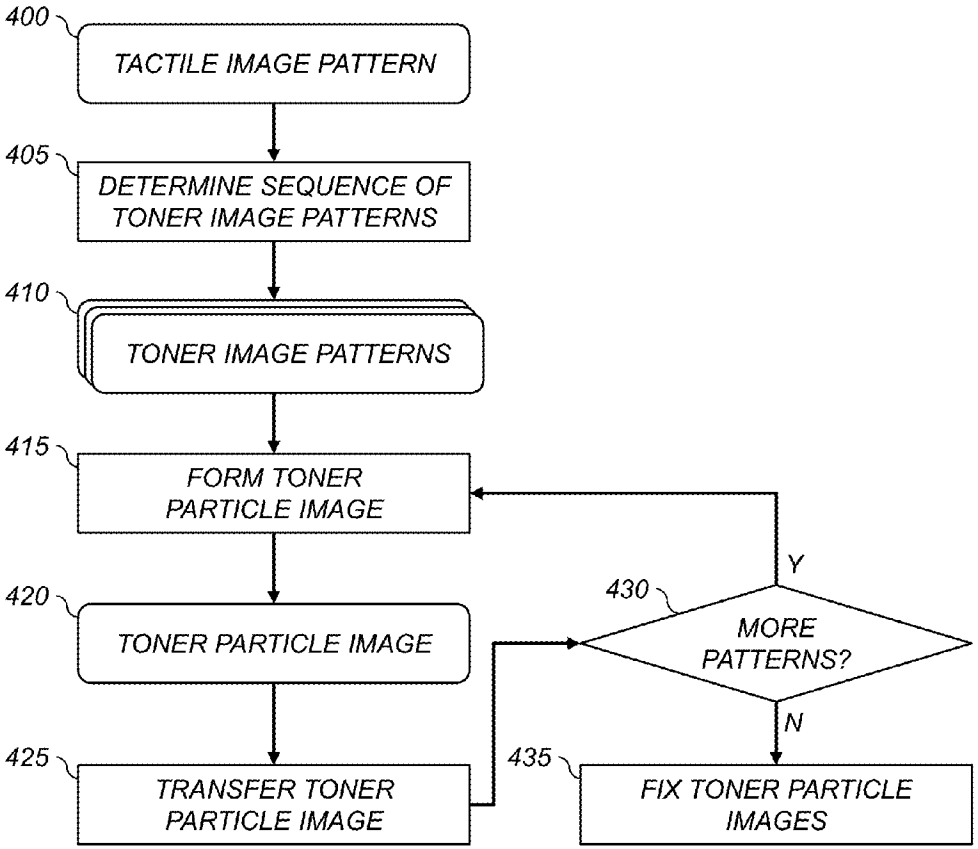
FIG. 5 is a flow diagram of a process for forming tactile patterns according to an embodiment of the present invention.

FIG. 5 shows a flow chart of a method for producing tactile images according to an embodiment of the present invention. The input to the process is a tactile image pattern 400 corresponding to a tactile image to be printed on the printer 100 (FIG. 1) generally, the tactile image pattern 400 will correspond to a channel of the input image, and will be in the form of a binary pattern of input pixels indicating pixel locations that should be printed with raised tactile features. For example, the tactile image pattern 400 can be a representation of a Braille image including a plurality of Braille characters. In some cases, the tactile image pattern 400 can have more than two levels to indicate different tactile feature heights.

A determine sequence of toner image patterns step 405 determines a set of toner image patterns 410 that are to be printed by the printer 100 (FIG. 1) In some cases, the toner image patterns 410 will be printed with clear (i.e., colorless) toner so that the resulting tactile features can be felt, but are invisible to the eye. In other cases, the toner image patterns 410 can be printed with a visible toner (e.g., black toner) so that they can be both felt and seen. In some embodiments, the determine sequence of toner image patterns step 405 is performed as a part of the image processing path 310 (FIG. 4), and the toner image patterns 410 are encoded as corresponding channels of the output pixels.

According to a preferred embodiment, the toner image patterns 410 include a plurality of annular shapes having inner and outer sizes, where the inner and outer sizes vary in a monotonic sequence. As used herein, the terms "annular" and "annulus" refer to shapes containing an outer perimeter and an inner perimeter, where toner is to be applied between the outer and inner perimeters. In some embodiments, the annular shapes are rings having substantially circular or elliptical perimeters. Alternatively, the annular shapes can be in the form of either regular or irregular polygons such as, but not limited to, squares, rectangles, hexagons, octagons, and triangles. The toner image patterns 410 are arranged so that when they are printed and transferred in register onto the receiver 42, they are substantially concentric and overlapping. In this way, the overlapping toner particle images form a tactile image feature having a hollow core.

Figure 6A:
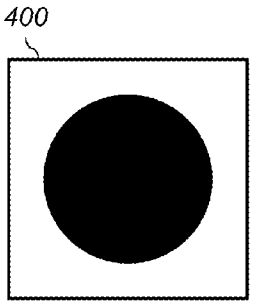
FIG. 6A is a diagram illustrating a sample tactile image pattern.

FIG. 6A shows an example of a tactile image pattern 400, which could be for example a single dot in a Braille character. The dark area in the tactile image pattern 400 correspond to the locations where a raised tactile image feature is to be produced.

Figure 6B:
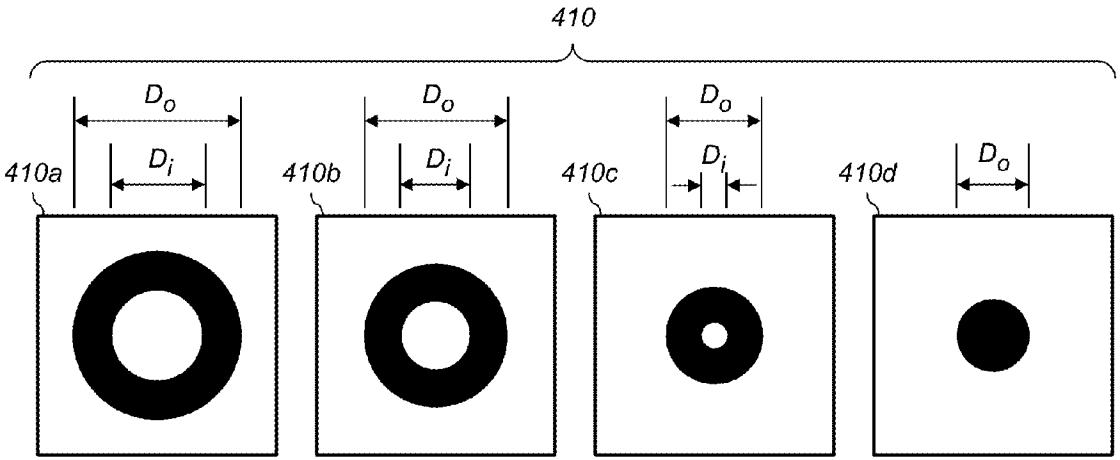
FIG. 6B illustrates a sequence of toner image patterns corresponding to the tactile image pattern of FIG. 6A.

FIG. 6B shows a sequence of toner image patterns 410 determined in accordance with the present invention. Toner image patterns 410*a*, 410*b* and 410*c* each consist of an annular shape having an outer size $D_o$ and an inner size $D_i$. (In the illustrated example, the sizes are diameters of the circular boundaries. For cases where non-circular annuli are used, the size can be given be any appropriate spatial dimension of the associated shapes.) The fourth tone image pattern 410*d* is a filled shape that has only an outer size $D_o$. It can be seen that the outer sizes $D_o$ of the Toner image patterns 410*a*, 410*b*, 410*c* and 410*d* monotonically decrease. Likewise, the inner sizes $D_i$ of the toner image patterns 410*a*, 410*b* and 410*c* also monotonically decrease. It can also be seen that the sizes are arranged so that the inner size $D_i$ of one pattern (e.g., toner image pattern 410*a*) overlaps with the outer size $D_o$ of the next pattern in the sequence (e.g., toner image pattern 410*b*).

In the Example described with respect to FIGS. 6A-6B, the tactile image pattern 400 and the toner image patterns 410 are shown with perfectly circular boundaries. This would correspond to the case where the original tactile image pattern 400 is specified as a graphical object (i.e., a circle with a specified radius at specified location) in a page description language (e.g., in a PDF file). In this case, the determine sequence of toner image patterns step 405 (FIG. 5) can specify the toner image patterns 410 by defining corresponding graphical objects having the desired sizes (e.g., a black circle have a diameter $D_o$ overlaid with a white circle having a diameter $D_i$).

Figure 7A:
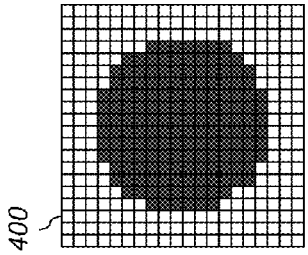
FIG. 7A is a diagram illustrating a sample tactile image pattern.
Figure 7B:
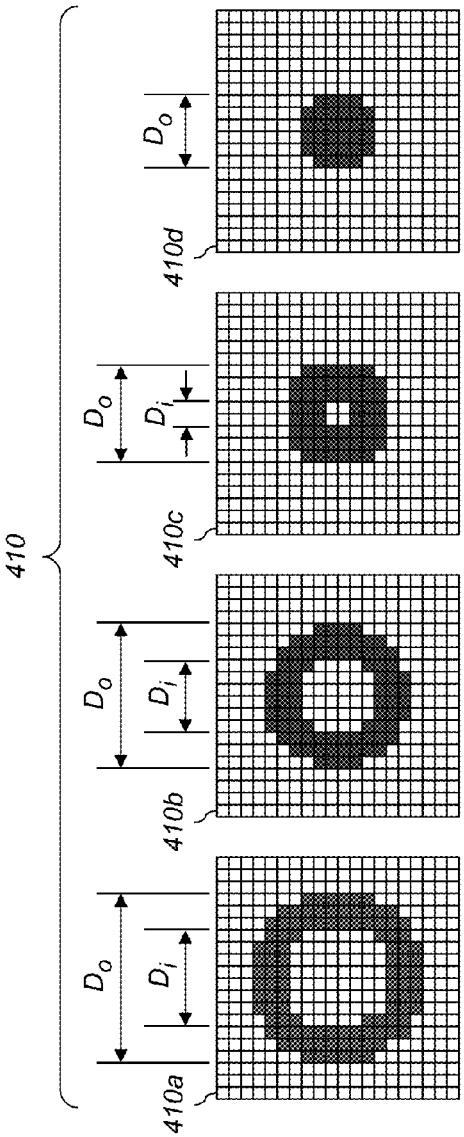
FIG. 7B illustrates a sequence of toner image patterns corresponding to the tactile image pattern of FIG. 7A.

In other embodiments, the tactile image pattern 400 may be specified as a bitmap image as shown in FIG. 7A, where the circular shape has been mapped to a grid of pixels. In this case, the determine sequence of toner image patterns step 405 can apply appropriate image processing operations that are known in the art to determine corresponding toner image patterns 410 as shown in FIG. 7B. For example, an erosion operator can be applied to the circular shape in the tactile image pattern 400 to define a smaller circular shape corresponding to the hole in the first toner image pattern 410*a*. The pixels contained in the smaller shape can then be set to zero toner image pattern 410*a*. A dilation operation can then be applied to the smaller shape to define the outer boundary of the second toner image pattern 410*b* so that it will overlap with the inner boundary of the first toner image pattern 410*a*. This process can be repeated to form all of the toner image patterns 410.

Returning to a discussion of FIG. 5, once the toner image patterns 410 have been determined, they are now sequentially printed onto the receiver 42. First, a form toner particle image step 415 is used to form a toner particle image on a primary imaging member, such as photoreceptor 206 (FIG. 3). As was described earlier, this is typically done by uniformly charging the photoreceptor 206 using a charging subsystem 210 (FIG. 3) and forming an electrostatic latent image by image-wise exposing the photoreceptor 206 according to one of the toner image patterns 410 using the exposure subsystem 220 (FIG. 3). The photoreceptor 206 is then brought into operational proximity to the development station 225 (FIG. 3) which deposits toner particles onto the electrostatic latent image to form a corresponding toner particle image 420 on the photoreceptor 206.

A transfer toner particle image step 425 is then used to transfer the toner particle image 420 to a receiver 42 such as paper, plastic, or metal, either directly from the photoreceptor 206 to the receiver 42 or by first transferring the toner particle image 420 to a intermediate transfer member 112 (FIG. 3) and subsequently from the intermediate transfer member 112 to the receiver 42. In some embodiments, the transfer toner particle image step 425 is performed by bringing the receiver into proximity with the toner particle image 420 and an electric field is provided that attracts the charged toner particles onto the receiver 42. The electric field can be provided by a corona charger or an electrically biased transfer roller.

As discussed earlier, the charge on the toner particles generates an electrostatic field that subtracts from the applied field in the presence of the toner structure. When attempting to produce tactile features using solid stacks of toner particles, this places a limit on the amount of toner than can be developed and transferred. An advantage of the present invention is that the high charge levels associated with solid stacks of toner are avoided, thereby mitigating the reduction in the electric field strength and allowing taller stacks of toner particles to be deposited onto the photoreceptor during the development of the electrostatic latent image, and then to be transferred to a suitable receiver.

A more patterns test 430 repeats the form toner particle image step 415 and the transfer toner particle image step 425 for each of the toner image patterns 410. In this way, the sequence of toner particle images 420 are transferred in register onto the receiver 42 in an overlapping fashion. It is important when practicing this invention that registration of the toner annular regions occurs on the receiver 42 and not on the intermediate transfer member 112 as transferring the toner annular regions in register on the intermediate transfer member 112 would cause the superimposed toner particle images 420 to be inverted upon transfer to the receiver 42 and negate the benefits of this invention.

Figure 8B:
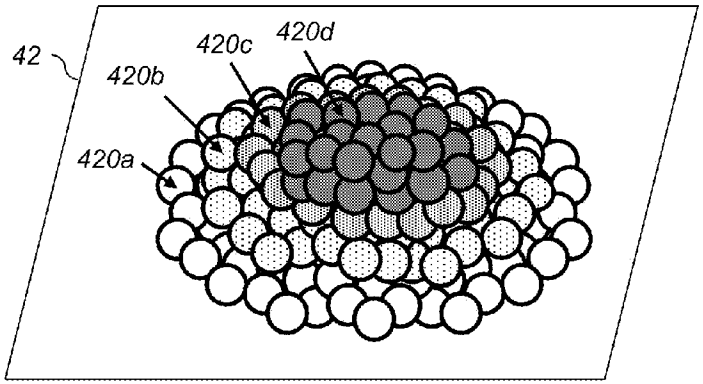
FIG. 8B shows perspective view of the toner particle images of FIG. 8A after they have been transferred to a receiver in a stacked arrangement.
Figure 8C:
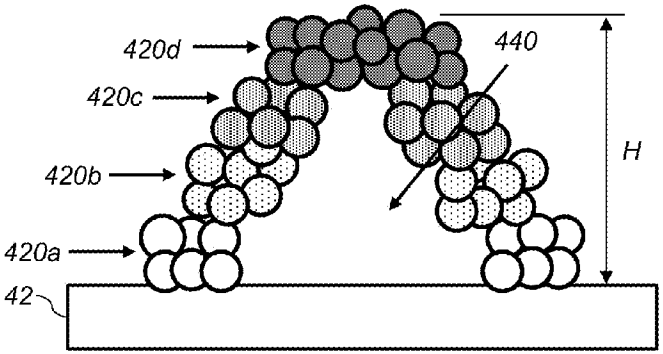
FIG. 8C shows cross-sectional view through the toner particle images of FIG. 8B.
Figure 8A:
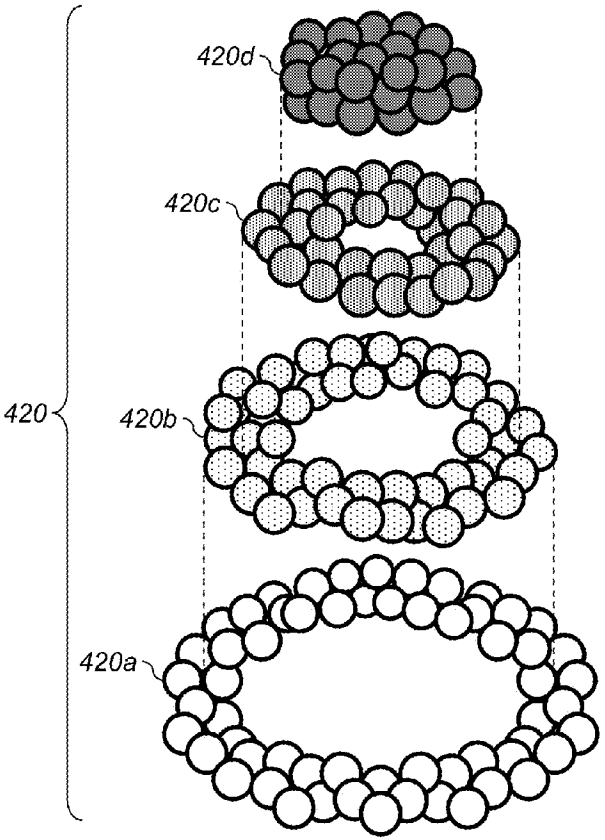
FIG. 8A shows perspective views of a sequence of toner particle images corresponding to the toner image patterns of FIG. 7B.

FIG. 8A illustrates perspective views of a sequence of toner particle images 420 formed in this manner, including a first toner particle image 420*a*, a second toner particle image 420*b*, a third toner particle image 420*c* and a fourth toner particle image 420*d*. It can be seen that they overlap in the sense that the inner size of toner annulus in one toner particle image 420 overlaps with the outer size of the next toner particle image 420 in the sequence.

FIG. 8B shows a perspective view of the toner particle images 420*a*-420*d* after they have been transferred to the receiver 42 in sequence. FIG. 8C shows a cross-sectional view through this same structure. It can be seen that the overlapping toner particle images 420*a*-420*d* combine to form a dome-like structure with a hollow core 440. Preferably, to form Braille patterns, the height H of the toner particle structure should be at least 100 μm.

The size and shape of the annular regions in the toner particle images 420 are important as the toner in the second toner particle image 420*b* must overlap the toner of the first toner particle image 420*a* for this invention to be effective. Specifically, it is important that the annular region in each successive toner particle image 420 be superimposable upon the annular region in the previous toner particle image 420 so that toner particles in successive toner particle images 420 will be in contact. To achieve this, it is desired that the annular regions have similar shapes and that the associated sizes have appropriate proportions. The average outer size of the toner annulus in each successive toner particle image 420 (e.g., toner particle image 420*b*) should generally overlap with average inner size of toner annulus in the preceding toner particle image 420 (e.g., toner particle image 420*a*) by at least 1/10 of the average toner diameter, and preferably by at least 1/4 of the average toner diameter.

While in some cases, the annulus size of a particular toner particle image 420 can be the same size or slightly larger than the annulus size of the previous toner particle image 420, the superposition of multiple toner particle images 420 should trend towards decreasing size. Generally, the final toner particle image 420 will not be annular, but rather will have a solid center and will form a cap on the superimposed annular structures, providing a closed structure having a shape similar to that of an igloo. However, in some embodiments, the final toner structure may have an open top.

Returning to a discussion of FIG. 5, it should be noted there are a number of different arrangements that can be used to perform the form toner particle image step 415 and the transfer toner particle image step 425 in various embodiments. In some embodiments, each of the toner particle images 420 can be formed on a different photoreceptor 206 (for example in a different printing module 31-35 (FIG. 1)). The toner particle images 420 can then be transferred in sequence onto the receiver 42 as it moves passed each printing module 31-35. This would require that each of the printing modules 31-35 that are involved with the process of printing the tactile image would need to use appropriate toner particles.

In other embodiments, each of the toner particle images 420 can be formed on a single photoreceptor 206 in a single printing module (e.g., printing module 35). In this case, after the first toner particle image 420*a* has been transferred to the receiver 42, the photoreceptor 206 is recharged and exposed in an image-wise fashion to form a latent image according to the second toner image pattern 410*b*. The latent image is then developed to form a second toner particle image 420*b*, which is transferred in register onto the receiver 42 by cycling the receiver 42 through the printing module 35 a second time. This process is repeated until all of the toner particle images 420 have been transferred in sequence onto the receiver.

After all of the toner particle images 420 have been transferred to the receiver 42, a fix toner particle image step 435 is used to fix the toner particles to the receiver 42. In a typical electrophotographic printer 100, this is done by transporting the receiver 42 to fuser module 60 containing heated fusing roller 62 and pressure roller 64 that form a nip 66 through which the toner image bearing receiver 42 passes, thereby subjecting the toner image bearing receiver 42 to a combination of heat and pressure that heats the toner particles to a temperature in excess of the glass transition temperature of the toner, thereby softening the toner and permanently fixing toner to the receiver. Generally, at least one of the fuser roller or pressure roller is coated with a thin layer of an elastomeric substrate typically having a Young's modulus between 3 MPa and 100 MPa that allows the nip 66 to have a finite width so that the receiver is in the nip 66 for a finite time to allow the toner to flow while being heated and subjected to pressure. The process of fusing typically presses the stack of toner that forms the unfused image, thereby reducing the height of the toner stack and making the final printed image more planar. This is clearly contrary to the objective of this invention and such as fuser is not preferred for use when practicing this invention.

When practicing this invention, it is preferred that the fuser heat the toner to a temperature in excess of the glass transition temperature without subjecting the superimposed toner annular regions to excessive pressure. One way to accomplish this is to use a highly compliant fusing roller 62, such as one having a foam coating, where the foam has a Young's modulus of less than 200 KPa. This can provide a fusing nip 66 with a substantially reduced pressure. However, as this method still brings the fusing roller 62 into contact with the toner particle images 420, it can still reduce the height of the tone stack to some degree. In a more preferred embodiment, no pressure roller 64 is used and the fusing roller 62 is brought into contact with the non-image-bearing side of the receiver 42. In this way, heat is added to the toner without applying any pressure. Similarly, in some embodiments, instead of a fusing roller 62, a heated member of finite width such as a hot shoe can be used. In a preferred embodiment, the image-bearing receiver 42 can be fixed using a non-contact fixing system which does not contact the receiver 42, and more specifically does not contact the image-bearing side of receiver 42. Any such method known in the art can be used in accordance with the present invention, such as radiant heating, RF heating, IR heating, convective heating, or microwave heating.

In some embodiments, a tack fixing process is used where the fix toner particle images step 435 is applied to at least partially fix the toner particle images 420 to the receiver 42 following each sequential transfer toner particle image step 425. In this case, some amount of heat is applied to the transferred toner particles to better hold them in place during the next iteration of the transfer toner particle image step 425.

Figure 9:
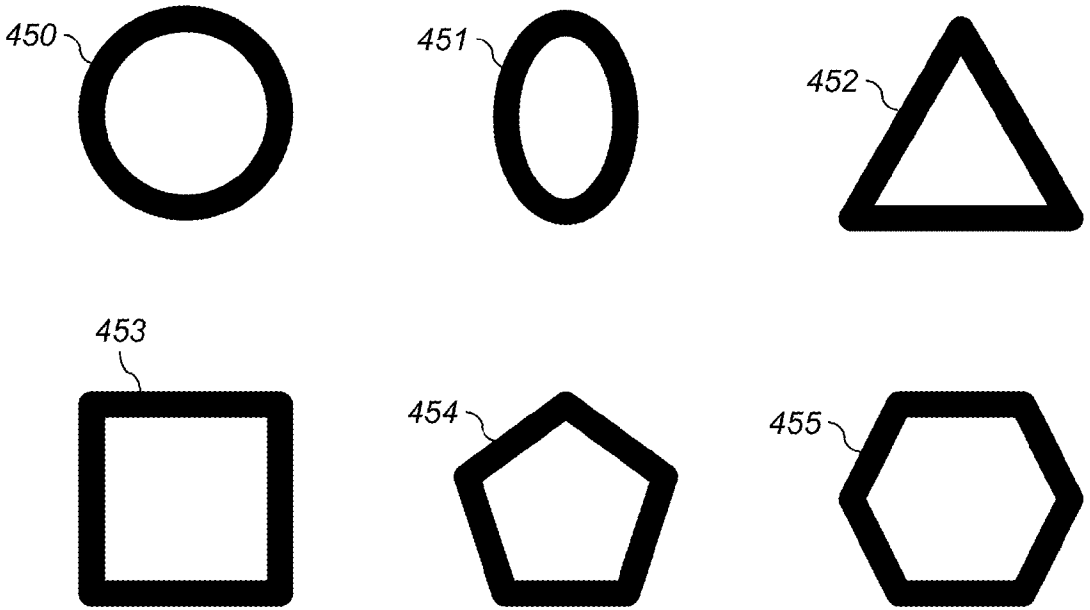
FIG. 9 is a diagram illustrating various annular shapes that can be used to form toner particle images in accordance with the present invention.

The annular shapes used to form the toner particle images 420 in the preceding examples have been circular in shape. As mentioned previously, the method of the present invention can also be practice with other types of annular shapes. FIG. 9 illustrates a few of those shapes, including a circular annulus 450, an elliptical annulus 451, a triangular annulus 452, a square annulus 453, a pentagonal annulus 454 and a hexagonal annulus 455.

Figure 10:
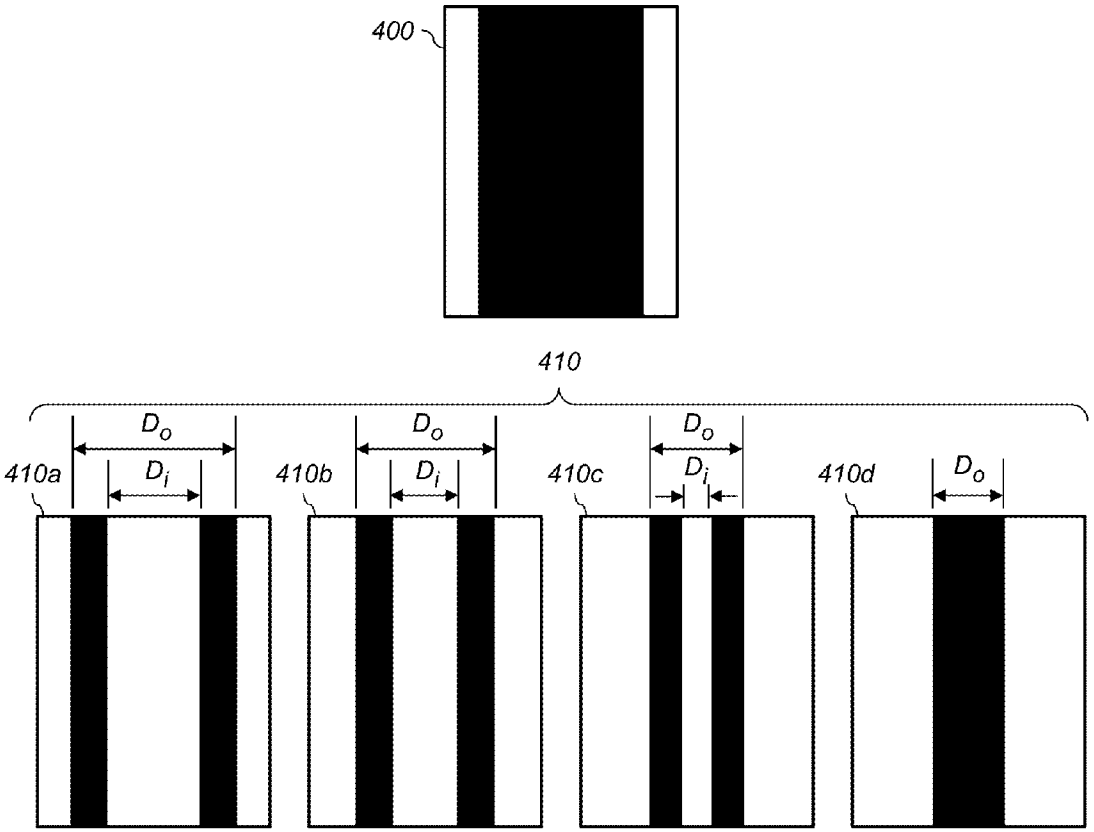
FIG. 10 illustrates another sample tactile image pattern including a linear feature, and a corresponding sequence of toner image patterns.

The method of the present invention can also be used to form other types of tactile patterns besides the small isolated shapes that were described with references to FIGS. 6-9. For example, the method can easily be extended to produce tactile patterns that include thin linear features. This is illustrated in FIG. 10, which shows a segment of a tactile image pattern 400 which includes a linear feature. In this case, the corresponding toner image patterns 410 are formed to build up a hollow tunnel structure. The first toner image patterns 410*a* includes two lines positioned at the outer edges of the linear feature. In successive toner image patterns 410*b* and 410*c*, the lines are moved closer together. The final toner image pattern 410*d* is a single wide line that forms a "roof" over the gap between the lines in the previous toner image pattern 410*c*. It will be obvious to one skilled in the art that this approach can also be used to form tactile patterns included curved lines. Linear features of this type (including straight or curved lines) can be treated as a type of annular shape that are narrow in a width direction and have an extended length direction.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image

39 fused image
40 supply unit
42 receiver
42*a* receiver
42*b* receiver
42*c* receiver
42*d* receiver
50 transfer subsystem
60 fuser module
62 fusing roller
64 pressure roller
66 fusing nip
68 release fluid application substation
69 output tray
70 finisher
81 transport web
86 cleaning station
99 logic and control unit
100 printer
102 roller
103 roller
104 transmission densitometer
105 power supply
109 inter-frame area
110 light beam
111 imaging member
112 intermediate transfer member
113 transfer backup member
121 imaging member
122 intermediate transfer member
123 transfer backup member
124 corona tack-down charger
125 corona tack-down charger
131 imaging member
132 intermediate transfer member
133 transfer backup member
141 imaging member
142 intermediate transfer member
143 transfer backup member
151 imaging member
152 intermediate transfer member
153 transfer backup member
201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 input pixel levels
305 workflow inputs
310 image processing path
315 output pixel levels
320 screening unit
325 screened pixel levels
330 print engine
335 print image data
400 tactile image pattern
405 determine sequence of toner image patterns step
410 toner image patterns
410*a* toner image pattern
410*b* toner image pattern
410*c* toner image pattern
410*d* toner image pattern
415 form toner particle image step
420 toner particle image
420*a* toner particle image
420*b* toner particle image
420*c* toner particle image
420*d* toner particle image
425 transfer toner particle image step
430 more patterns test
435 fix toner particle images step
440 hollow core
450 circular annulus
451 elliptical annulus
452 triangular annulus
453 square annulus
454 pentagonal annulus
455 hexagonal annulus
ITM1-ITM5 intermediate transfer member
PC1-PC5 imaging member
$R_n$-$R_{(n-6)}$ receiver
S slow-scan direction
TR1-TR5 transfer backup member

The invention claimed is:

1. An electrographic printing system for forming a tactile printed image on a receiver medium, comprising:

an image processing path that provides a sequence of image patterns including a plurality of annular shapes having associated inner and outer sizes, the inner and outer sizes of the annular shapes varying in a monotonic sequence;

one or more printing modules including:

an image forming system adapted to form an electrostatic latent image on a primary imaging member according to a supplied image pattern;

a development subsystem adapted to form a toner particle image on the primary imaging member by depositing charged toner particles in accordance with the electrostatic latent image; and a transfer subsystem adapted to transfer the toner particle image to the receiver medium;

a fixing subsystem adapted to permanently attach the transferred toner particle images to the receiver medium; and a controller system adapted to:

control the one or more printing modules to form a sequence of toner particle images corresponding to the sequence of image patterns, and to sequentially transfer the sequence of toner particle images in register onto the receiver medium such that the annular shapes in the toner particle images overlap to form a tactile image feature having a hollow core; and control the fixing subsystem to permanently attach the transferred toner particle images to the receiver medium.

2. The electrographic printing system of claim 1 wherein the annular shapes are substantially circular or elliptical rings.

3. The electrographic printing system of claim 1 wherein the annular shapes have substantially polygonal boundaries.

4. The electrographic printing system of claim 3 wherein the primary imaging member is a photoreceptor, and wherein the image forming subsystem includes an exposure system that provides an image-wise exposure pattern onto the photoreceptor according to the supplied image pattern, thereby forming the electrostatic latent image.

5. The electrographic printing system of claim 1 wherein the tactile image features are lines or curves.

6. The electrographic printing system of claim 1 wherein the transfer subsystem transfers the toner particle images to an intermediate transfer member, and then transfers the transfer toner particle images from the intermediate transfer member to the receiver medium.

7. The electrographic printing system of claim 1 wherein the transfer subsystem transfers the toner particle images to the receiver medium using a corona charger.

8. The electrographic printing system of claim 1 wherein the fixing subsystem is a non-contact fixing system.

9. The electrographic printing system of claim 1 wherein the fixing subsystem is controlled to at least partially fix the transferred toner particle images between each sequential transfer operation.

10. The electrographic printing system of claim 1 wherein the tactile image feature is an element of a Braille character adapted to convey information to a visually-impaired person.

11. The electrographic printing system of claim 1 wherein the tactile image feature is an element of a texture pattern.

12. The electrographic printing system of claim 1 wherein the toner particles are dry toner particles having a median volume-weighted diameter between 12 and 30 microns.

13. The electrographic printing system of claim 1 wherein the electrographic printing system is an electrophotographic printing system.

* * * * *